United States Patent [19]

Kishi

[11] Patent Number: 4,541,706

[45] Date of Patent: Sep. 17, 1985

[54] IMAGE DISPLAY APPARATUS

[75] Inventor: Hirotoshi Kishi, Tokyo, Japan

[73] Assignee: Canon Kabushiki Kaisha, Tokyo, Japan

[21] Appl. No.: 554,626

[22] Filed: Nov. 23, 1983

[30] Foreign Application Priority Data

Nov. 29, 1982 [JP] Japan ..... 57-209178

[51] Int. Cl.[4] ..... G03G 15/00

[52] U.S. Cl. ..... 355/3 R; 355/3 DD; 355/5; 355/16; 346/160

[58] Field of Search ..... 355/5, 3 R, 3 DD, 8, 355/10, 16; 346/108, 153.1, 160; 358/300

[56] References Cited

U.S. PATENT DOCUMENTS 3,316,805 5/1967 Cary ..... 355/4

3,504,969 4/1970 Martel ..... 355/5

3,848,990 11/1974 Otubo et al. ..... 355/10 X 4,136,943 1/1979 Koizumi ..... 355/16 X 4,216,378 8/1980 Monetta ..... 250/201

*Primary Examiner*—A. T. Grimley

*Assistant Examiner*—J. Pendegrass

*Attorney, Agent, or Firm*—Fitzpatrick, Cella, Harper & Scinto

[57] ABSTRACT

A display apparatus for displaying image information of outputs of information processing means, such as a computer. The display is made with the use of electrophotography. The photosensitive member is in flat plate form, which has a transparent conductive base at a first side and a photoconductive layer at a second side. The information is applied to the first side, and the visible image is formed on the second side.

13 Claims, 8 Drawing Figures

IMAGE DISPLAY APPARATUS

BACKGROUND OF THE INVENTION

1. Field of the Invention

The present invention relates to an image display apparatus for displaying data in an information processing device, such as computers, as a visible image using an electrophotography.

2. Description of the Prior Art

Image display apparatuses for displaying data in computers, facsimiles and the like are generally of a cathode ray tube (CRT) type. In place of such image display apparatuses, the applicant has proposed an image display apparatus which comprises an image bearing web in the form of an endless moving belt (U.S.S.N. Nos. 445070, 509767 and 525212).

The image display apparatus proposed by the applicant is shown in FIG. 1 which comprises a casing 1 and an endless belt-shaped photosensitive web 8 movably mounting within the casing 1. The photosensitive web 8 is intermittently driven by drive means (not shown) and guided by guide rolls 9, 10, 11 and 12. There is provided a semiconductor laser (not shown) ehich is adapted to generate output light beams modulated by electric image signals. The output light beam impinges on the inner face of the photosensitive web 8 and scan in one direction the same by a scanner 8 through a f-$\theta$ lens 6 and mirror 7. The photosensitive web 8 may consist of a transparent, electrically conductive substratum and a photoconductive layer formed thereover.

In an exposure position A, a development device 15 is disposed in opposition to the outer face of the belt-shaped photosensitive web 8 and comprises a sleeve 17 within which a magnet 16 is mounted to rotate in the direction shown by an arrow in FIG. 1. An electrically conductive and magnetic developer (toner) 18 is supplied to the surface of the sleeve 17 and will contact with the surface of the photosensitive web 8 after the toner layer has been uniformly regulated by a blade 19. DC voltage is applied across the sleeve of the development device and the substratum of the photosensitive web 8. Adjacent to the exposure and developement position there are located rollers 13 and 14 which serve to maintain the photosensitive web 8 flat so that the gap between the photosensitive web surface and the sleeve of the development device will exactly be kept constant. An image is written on the surface of the photosensitive web in the position A by the use of light beam and then developed into a toner image which will be fed to a display section 2.

The display section 2 includes a rectangular window 3 formed in the front face of the casing 1 and a transparent member 4, such as glass or resin mounted over the window 3 through which the toner image on the photosensitive web can be observed externally. The photosensitive web 8 may be stopped automatically or manually for a given period of time if a predetermined location thereof on which the visible image is formed reaches the region of the window 3. In this manner, the toner image on the photosensitive web 8 surface can be observed at the window 3 through the transparent member 4.

The image display apparatus further comprises a lamp 20, if necessary, for erasing any hysteresis which possibly remains on the photosensitive web 8. The lamp 20 is in its ON state only when the photosensitive web 8 is being moved, and it is turned OFF with the stop of the web 8.

When a display of another information is desired, the photosensitive member 8 is again moved, and the photosensitive member having a previous image can be used as it is. There is no need of cleaning the toner of the previous image.

The principle of the operation is disclosed in the above-mentioned U.S.S.N. Nos. 445070 or 525212. So, a detailed explanation is omitted for the sake of simplicity, but the operation is described briefly in conjunction with FIGS. 2 and 3.

FIG. 2 shows the state of charge in the bright area of information light. When the toner 18 contacts the photosensitive web 8 while a voltage is being applied to the toner through the sleeve 17, an electrical field is applied to the photoconductive layer 8*c*. At this time, if the information light is projected, photo-carriers e are produced in the photoconductive layer 8*c* and then moved to near the surface of the photoconductive layer 8*c* under the action of the electric field. As a result, a strong electrostatic attraction force acts between the toner 18 carried on the sleeve 17 by the magnetic force of rotating magnet 16 and the photoconductive layer 8*c* so that the toner 18 will be diposited on the photoconductive layer 8*c*, that is, the surface of the photosensitive web 8. The sleeve 17, instead of the magnet 16, may be rotated.

In the illustrated apparatus, the photoconductive layer 8*c* is of an N-type semiconductor, while a positive voltage is applied to the toner 18. The photo-carriers e, which have been produced near the substratum in the photoconductive layer 8*c* on the irradiation of the information light LB, can satisfactorily be moved toward the photoconductive layer 8*c*. As a result, the toner 18 can be deposited on the photosensitive web 8 under the action of the strong electrostatic attraction force between the toner 18 and the photosensitive web 8.

FIG. 3 shows the state of charge in the dark area. When an electric field is applied across the toner 18 and the transparent conductve layer 8*b* of the substratum, an electrostatic attraction force is produced therebetween. However, this electrostatic attraction force is relatively small since the toner 18 and the conductive layer 18*b* are spaced away from each other by the photoconductive layer 8*c*. The toner 18 is therefore forced to separate from the photoconductive layer 8*c*, that is, the photosensitive web 8 due to various causes such as the magnetic force of the rotating magnet 16 within the fixed sleeve 17, and the attracting force acting among particles in the toner 18 and so on.

If it is desired to effect the change of toner image on the photosensitive web 8, a new image can be formed thereon simply by causing the photosensitive web 8 to pass by the exposure and development position. In other words, if the toner holding portion of the photosensitive web is to be changed to a non-toner-holding portion, the toner 18 reduced in its electrostatic attraction force is removed from the photosensitive web 8 under the influence of the magnetic field in the magnet 16 to provide a bright area on which no toner is deposited. On the other hand, if the toner holding area of the photosensitive web 8 is to be kept as it is, photo-carriers e are again injected under the action of information light so that new toner 18 will be attracted to the photosensitive web 8 against the action of the magnetic field to keep the toner thereon. Thus, the toner image on the photosensitive web 8 will not influence the subsequent formation of image. This means that an additional cleaning means is not required in the image display apparatus.

As shown in FIGS. 2 and 3, the image display apparatus further comprises a polyethylene terephthalate film 8*a* supporting the conductive layer 8*b* and a source of voltage E for the sleeve.

The photoconductive layer may be of ZnO, Se, SeTe, $As_3Se_2$ or the like as well as CdS.

In the aforementioned arrangements of the image display apparatus, the image bearing web in the form of the belt-shaped photosensitive or heat-sensitive web on which an image is to be formed is repetitively used. As will be clearly seen from the drawings, the photosensitive member 8 is repeatedly bent or deformed. This affects the service life of the photosensitive member 8. It is subjected to repeated stresses so that crack, damage or peeling could happen thereto with the result of no function of the image bearing. Also, since it is a belt, prevention has to be considered as to the oblique belt movement, which prevention would result in a complicated structure. Additionally, there is a problem of the toner scattering which may be caused by the rotation of the belt.

SUMMARY OF THE INVENTION

It is an object of the present invention to provide an apparatus for displaying an image with high reliability and longer service life of the image bearing member.

This and other objects, features and advantages of the present invention will become more apparent upon a consideration of the following description of the preferred embodiment of the present invention taken in conjunction with the accompanying drawings.

According to the preferred embodiment of the present invention, these objects can be accomplished by an image display device using an electrophotographic image formation system, which comprises a fixed and flat image bearing member having a conductive layer at a first side and a photoconductive layer at a second side, light information means for applying light information to the first side of said image bearing member, developing means for forming, on the second side of the image bearing member, a visible image with toner particles in accordance with the light information applied by said light information means, and a housing for accommodating said image bearing member and said developing means, said housing being provided with an opening for allowing observation of the visible image.

The image display apparatus of such structure has a flat image bearing member which is not bent in use, so that the photosensitive layer and the conductive layer are free from damage which may otherwise be caused thereto by the bending. The developing means simply moves in parallel with the flat surface of the photosensitive member so that no complicated drive means are required. The toner on the photosensitive member does not scatter since the toner is moved between the developing means and a fixed photosensitive member.

DESCRIPTION OF THE PREFERRED EMBODIMENTS

Preferred embodiments of the present invention will now be described.

Figure 1:
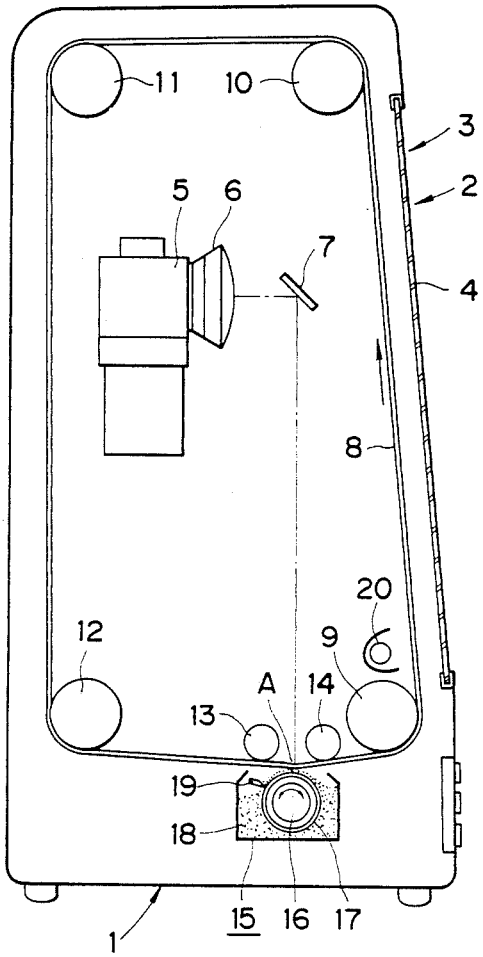
FIG. 1 shows a cross-section of a conventional image display apparatus.
Figure 4:
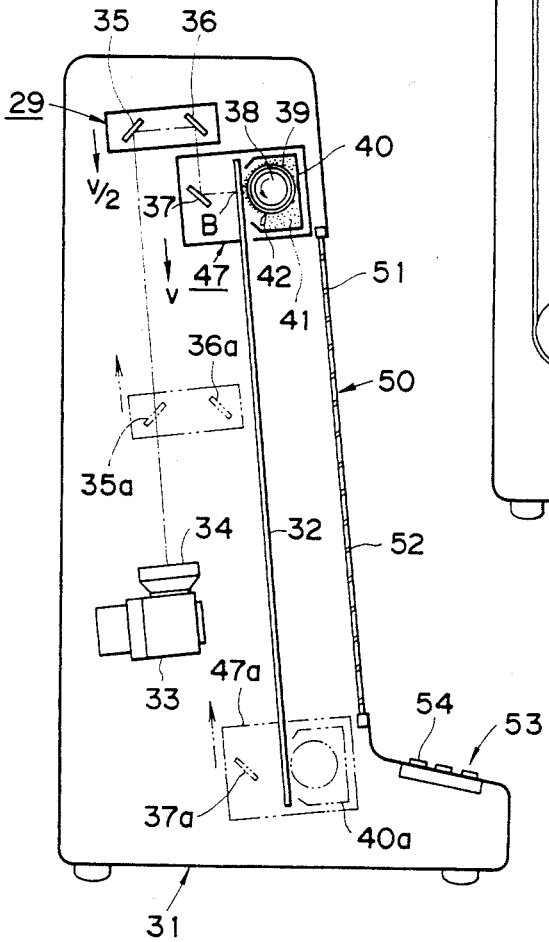
FIG. 4 is a cross section of a part of an apparatus according to an embodiment of the present invention.
Figure 2:
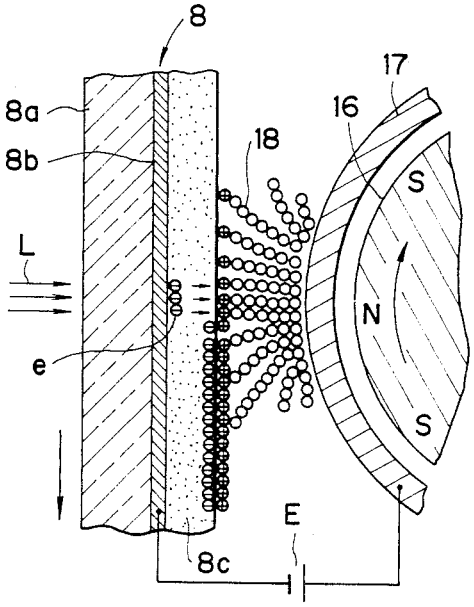
FIG. 2 and 3 illustrate an example of the image formation usable with the apparatus of the present invention.
Figure 3:
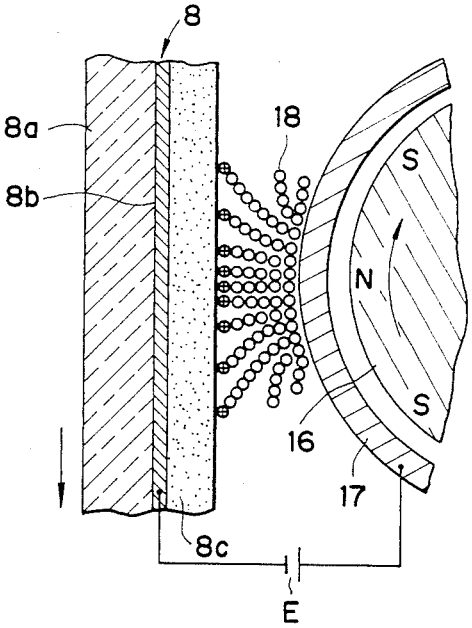
Figure 5:
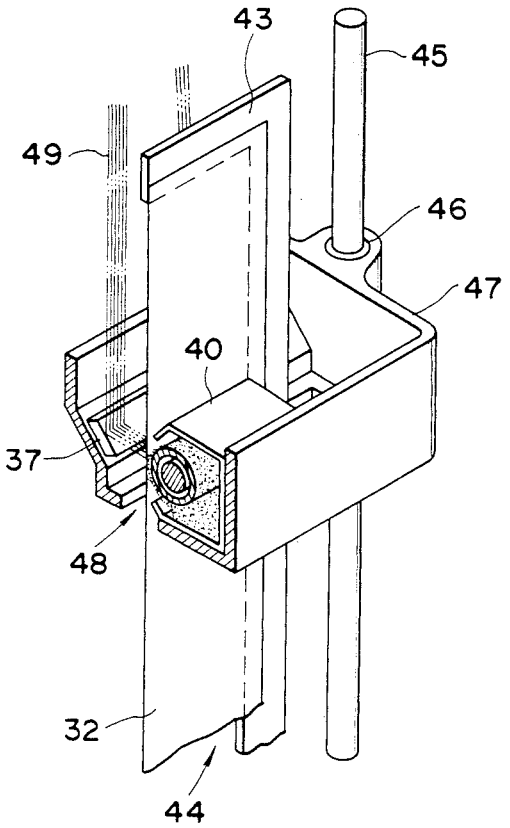
FIG. 5 is a perspective view of a developing device.

FIG. 4 is a cross-sectional view of an apparatus according to a first embodiment of the present invention. FIG. 5 shows a perspective view of a part of the apparatus of FIG. 4. A housing 31 of the apparatus contains a photosensitive member 32, which is scanned in one direction by a scanner with a laser beam emitted from a semiconductor laser as an information-modulated beam. More particularly, it is scanned therewith and exposed thereto through an *f*-$\theta$ lens 34 and mirrors 35, 36 and 37 at its back surface (a first surface). The mirror 37 moves at a speed v between the position shown by the solid lines and the position (37*a*) shown by the chain lines, while the mirrors 35 and 36 move at a speed of v/2 between the position shown by the solid lines and the position shown by the chain lines 35*a* and 36*a*, so that the optical path length is kept constant. The photosensitive member includes a base which is transparent and conductive, and a photoconductive layer thereon.

The mechanisms for driving the mirrors 35, 36 and 37 under the above-described speed relation, may be similar to that for an electrophotographic apparatus wherein two mirrors are moved at the speed ratio of 2:1. As shown in FIG. 4, the mirror 35 and 36 are fixed on the first supporting member 29, while the mirror 37 is fixed on the second supporting member 47. The first and second supporting members 29 and 47 are moved along guiding means 45.

Figure 6:
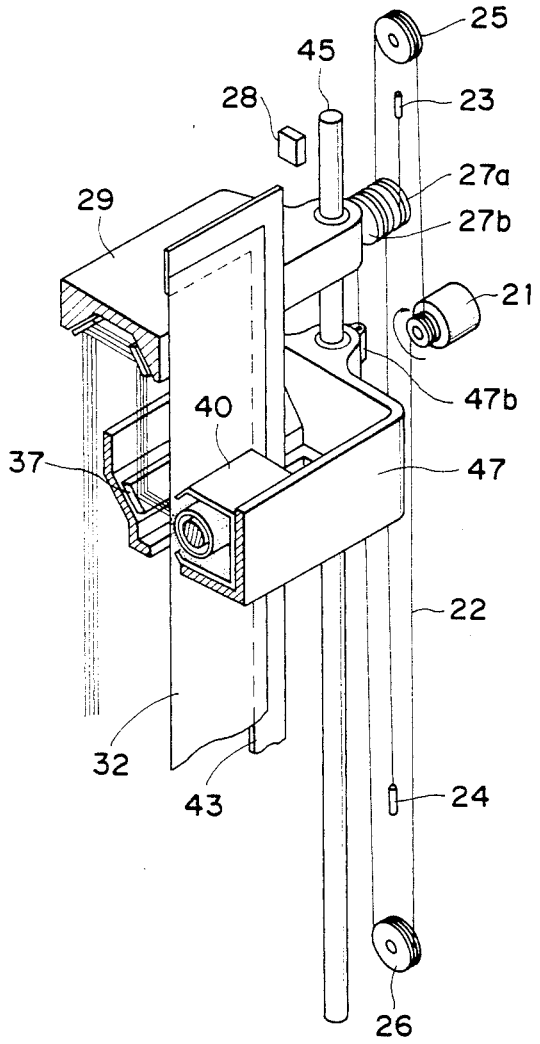
FIG. 6 is a perspective view of a driving mechanism for an optical system and the developing device.

FIG. 6 shows detailed structure of the mechanisms for driving the first and second supporting means 29 and 47. The supporting members 29 and 47 are driven by a wire 22 which is driven by a reversible motor 21. The wire has opposite ends 23 and 24 fixed to the main body of the apparatus. The wire is entrained around pulleys 25 and 26 journalled on the main body. The supporting member 29 is provided with two pulleys 27*a* and 27*b*. One of the ends 23 of the wire 22 is fixed on the main body of the apparatus after entrained around the pulley 27*a*. The other end 24 of the wire 22 is fixed to a part 47*b* of the second supporting member 47 after being entrained around the pulley 27*b*.

When the motor 21 rotates in the direction shown by the arrow the supporting members 29 and 47 move at the speed ratio of 2:1. To limit the upward movement of the first supporting member 29, there is provided a sensor 28 which may be a microswitch or photo-coupler. The lower limit thereof is similarly controlled by an unshown sensor.

To the opposite side (a second surface) of the photosensitive member 32, there is a developing device 40 including a magnet 38 rotatable in the direction shown by the arrow and a sleeve 39 of non-magnetic material. The electrically conductive and magnetic toner 41 on the sleeve 39 surface is regulated to be uniform by a blade 41 and contacted to the photosensitive member 32 surface. Between the sleeve 39 and the base of the photosensitive member 32, a DC voltage is applied from an unshown in DC source. The developing device 40 moves integrally with the exposure device, while the distance between the photosenitive member 32 surface and the sleeve 39 surface (a second surface) is maintained accurately.

FIG. 5 shows an example of a mechanism for keeping the exposure position and the developing position. In this Figure the photosensitive member 32 is fixed to the supporting frame 43 which has a rectangular opening 44 in the middle thereof. Along the photosensitive member 32, guiding means, i.e., a guiding rod, 45 is fixed to the apparatus. The guiding rod 45 supports a slidable bearing 46 fixed to the supporting frame 47, which is reciprocable through the above-described pulleys and wire 22 by the driving motor 21. To the supporting frame 47, the mirror 37 and the developing device 40 are fixed. The supporting frame 47 is provided with a slit opening 48, through which the photosensitive member 32 is disposed between the mirror 37 and the developing device 40. Thus, the developing device is moved, while the opposing relation between the developer and the exposure position are being kept. During the movement, the toner image is continuously formed on the second surface of the photosensitive member 32. Upon termination of one face image formation, the supporting frame 47 stops at an end of the photosensitive member 32 by the control using the sensor as described hereinbefore.

When a new image is to be displayed, the supporting frame 47 is returned to its original position, and the above-described process is repeated with another image signals. The photosensitive member 32 is directly reusable without the necessity of removing the existing toner images from the photosensitive member 32.

As shown in FIG. 4, the apparatus includes a display portion 50 for allowing the operator to observe the toner image formed on the second surface of the photosensitive member 32. The display portion 50 includes a rectangular opening 51 in the front part of the casing 31 and a transparent member 52 covering the opening 51, through which the toner image on the photosensitive member 32 can be seen.

In operation of the above-described apparatus, a display key 54 on the operating panel 53 is actuated by an operator. Then, the mirror 35 and 36 and the frame 47 supporting the mirror 37 and the developing device 40, located at the position shown by solid lines in FIG. 4, start and continue moving downwardly until they stop at the positions 35*a*, 36*a*, 47*a*, 37*a* and 40*a* as shown by the chain lines. During such movement, the image information beam scans the back face of the photosensitive member 32 to expose it to the information beam. On the opposite surface, a toner image is continuously formed substantially simultaneously therewith. The thus formed image is observed through the transparent member 52 at the display portion 50.

When a new image is to be formed the above steps are repeated.

Figure 7:
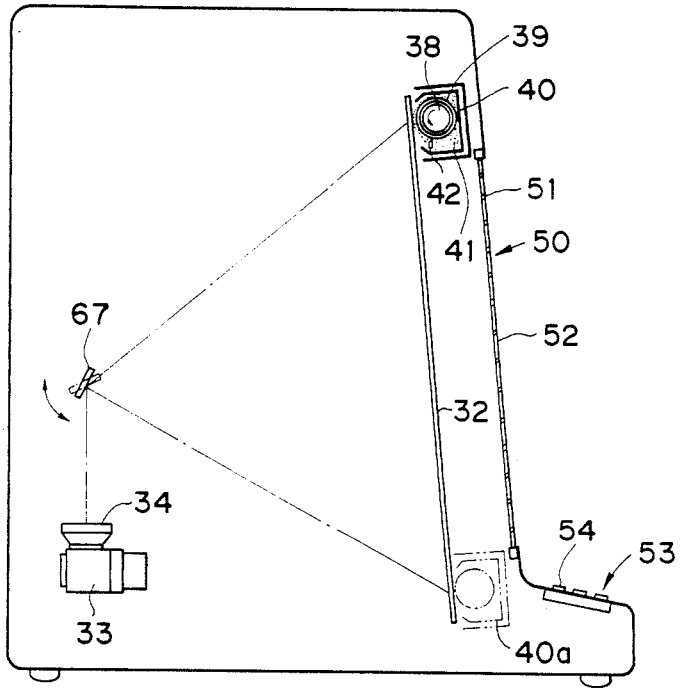

In the foregoing embodiments, the mirrors are moved at the speed ratio of 2:1 as a part of exposure means. However, a single mirror 67, as shown in FIG. 7, may be used, which is rotatable about an axis extending horizontally in parallel to the photosensitive member. By using such a mirror 67, the beam is deflected to scan the entire surface of the photosensitive member 32.

In this case, the mirror 67 is required to be rotated about the axis at non-uniform speed so as to move the beam on the photosenitive member 32 surface at a uniform speed. This is accomplished by using the mechanism disclosed in U.S. Pat. No. 4216378. The synchronization between the exposure station and the developing station is made at the start of the read-out of the information, when such a mechanism is used. As regards the proper focusing of the beam spot, the depth of focus of the $f-\theta$ lens may be used, or another lens may be disposed between the mirror 67 and the photosensitive member 32.

Figure 8:
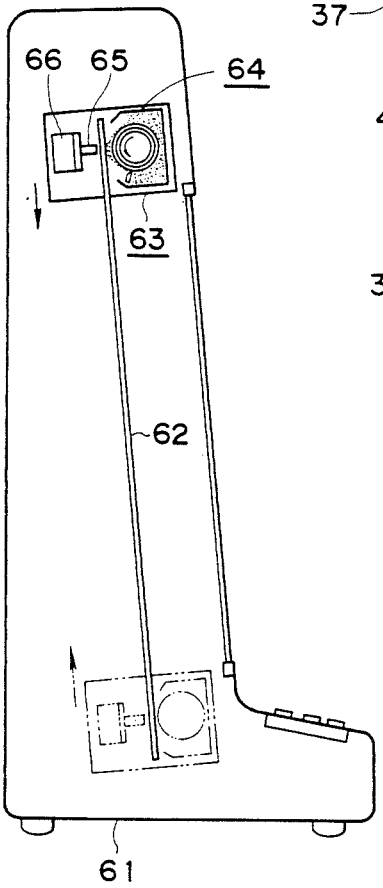
FIGS. 7 and 8 show cross-sections of apparatus according to other embodiments of the present invention.

A further example of the present invention will be described in conjunction with FIG. 8. In this embodiment, an LED array or arrays, known per se, are used as the image information application means. The housing 61 contains a fixed photosensitive member 62, along which a supporting member 63 is movable at a predetermined speed. The supporting member 63 supports a developing device 64 fixed thereto opposed to the front face of the photosensitive member 62. Across the photosensitive member there is an LED array 65 and its driver 66, which are fixed to the supporting member 63, correspondingly to the developing device 64. The LED elements are turned on and off in response to electric signals representing the image. The developing device and the LED arrays 65 are integrally movable. The other parts of the apparatus of this embodiment are similar to those of the foregoing embodiment (FIGS. 4 and 5), so that detailed explanations thereof are omitted for the sake of simplicity.

In place of the LED array, a combination of a linear light source having the length equal to the width of the scanning range and an optical shutter element array such as PLZT, may be used, wherein the shutter elements are controlled in response to image electric signals.

Although the foregoing embodiments have been described as having a commmon supporting means both for the exposure means and the developing means, the supporting means may have different supporting members for them, respectively, and they are synchronously moved with the use of wire and ball screws.

According to the present invention, an image display device using an electrophotographic image formation system is provided which comprises a fixed and flat image bearing member having a conductive layer at a first side and a photoconductive layer at a second side, light information means for applying light information to the first side of said image bearing member, developing means for forming, on the second side of the image bearing member, a visible image with toner particles in accordance with the light information applied by said light information means, and a housing for accommodating said image bearing member and said developing means, said housing being provided with an opening for allowing observation of the visible image, and therefore, the photosensitive member is kept still so that it is not subjected to repeated bending stresses. The photosensitive member is hardly damaged by, for example, cracks, scores, tears and peeling. Thus, the durability thereof is remarkably increased.

Additionally, the toner scattering which may be caused by the bending of the photosensitive member is prevented. Also, the image bearing member can be a partition wall for separating the space wherein the toner particles are used and the space which accommodates the optical system, so that the optical system may be protected from the toner particles which can stain it.

The second surface, i.e., the front surface, of the photosensitive member may be of a light color or white color to increase the image contrast. For this purpose, a coloring layer may be formed on the photoconductive layer, or a protecting layer may be used separately from the photoconductive layer.

As for the image forming process, other processes may be used if the image light is applied to one side of an image bearing member, and the image is developed at the other side thereof.

While the invention has been described with reference to the structures disclosed herein, it is not confined to the details set forth and this application is intended to cover such modifications or changes as may come within the purposes of the improvements or the scope of the following claims.

What is claimed is:

1. An image display device using an electrophotographic image formation system, comprising:

a fixed and flat image bearing member having a conductive layer at a first side and a photoconductive layer at a second side;

light information means or applying light information to the first side of said image bearing member;

developing means for forming, on the second side of the image bearing member, a visible image with toner particles in accordance with the light information applied by said light information means; and a housing for accommodating said image bearing member and said developing means, said housing being provided with an opening for allowing observation of the visible image.

2. A device according to claim 1, wherein said image bearing member has a transparent supporting member at the first side, a transparent conductive layer thereon and a photoconductive layer thereon.

3. A device according to Claim 2, wherein the photoconductive layer has a colored layer thereon at the second side.

4. A device according to claim 1, 2 or 3, wherein said visible image forming means contains conductive toner particles, and a bias voltage is applied between the toner particles and the conductive layer of said image bearing member to form the visible image substantially simultaneously with the light information application thereto.

5. A device according to claim 1, wherein said light information means includes scanning means for producing a laser beam modulated in accordance with information to be displayed, and mirror means for introducing the laser beam to said image bearing member.

6. A device according to claim 5, wherein said mirror means is supported on a member movable along the first side of said image bearing member.

7. A device according to claim 6, wherein the member for supporting said mirror means also supports said visible image forming means.

8. A device according to claim 5, wherein said mirror means includes a stationary mirror rotatable about an axis parallel to the direction of the scan by said scanning means and parallel to the image bearing member.

9. A device according to claim 1, wherein said light information means moves along the first side of said image bearing member, and includes an array of elements having independent light emitting parts.

10. A device according to claim 9, wherein said array is an array of LED elements.

11. A device according to claim 9, wherein said light information means includes an array of PLZT element arrays.

12. A device according to claim 4 wherein said light information means includes scanning means for producing a laser beam modulated in accordance with information to be displayed, and mirror means for introducing the laeser beam to said image bearing member.

13. A device according to claim 4 wherein said light information means moves along the first side of said image bearing member, and includes an array of elements having independent light emitting parts.

* * * * *

UNITED STATES PATENT AND TRADEMARK OFFICE

CERTIFICATE OF CORRECTION

PATENT NO. : 4,541,706

DATED : September 17, 1985

INVENTOR(S) : HIROTOSHI KISHI

It is certified that error appears in the above-identified patent and that said Letters Patent is hereby corrected as shown below:

Column 2, line 25, change "diposited" to --deposited--.

Column 5, line 29, change "signals" to --signal--.

Column 7, line 19, change "or" to --for--.

Signed and Sealed this

*Twelfth* Day of *August 1986*

[SEAL]

*Attest:*

DONALD J. QUIGG

*Attesting Officer*

*Commissioner of Patents and Trademarks*